US009325128B2

(12) United States Patent
Chen et al.

(10) Patent No.: US 9,325,128 B2
(45) Date of Patent: Apr. 26, 2016

(54) ELECTRICAL CONNECTOR HAVING A TERMINAL WITH TWO CONTACT PARTS AND A SOLDER PART

(71) Applicant: JESS-LINK PRODUCTS CO., LTD., New Taipei (TW)

(72) Inventors: Chun-Fu Chen, New Taipei (TW); Yun-Chang Yang, New Taipei (TW); Cheng-Chung Lai, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 0 days.

(21) Appl. No.: 14/632,606

(22) Filed: Feb. 26, 2015

(65) Prior Publication Data

US 2016/0093994 A1 Mar. 31, 2016

(30) Foreign Application Priority Data

Sep. 26, 2014 (TW) ..... 103133437 A

(51) Int. Cl.
*H01R 13/648* (2006.01)
*H01R 24/64* (2011.01)
*H01R 13/6581* (2011.01)

(52) U.S. Cl.
CPC ..... *H01R 24/64* (2013.01); *H01R 13/6581* (2013.01)

(58) Field of Classification Search
CPC ..... H01R 13/648; H01R 13/6485; H01R 13/658; H01R 13/65802; H01R 23/7021; H01R 23/7073; H01R 23/6873
USPC ..... 439/74, 660, 607.01, 607.4
See application file for complete search history.

(56) References Cited

U.S. PATENT DOCUMENTS

| | | | | |
|---|---|---|---|---|
| 7,442,057 | B2 * | 10/2008 | Ko | H01R 12/716 439/101 |
| 7,955,136 | B1 * | 6/2011 | Lai | H01R 13/502 439/660 |
| 8,113,882 | B1 * | 2/2012 | Chen | H01R 13/6581 439/607.01 |
| 8,936,492 | B2 * | 1/2015 | Ho | H01R 12/724 439/660 |
| 2013/0171884 | A1 * | 7/2013 | Ho | H01R 12/724 439/660 |
| 2013/0344739 | A1 * | 12/2013 | Shih | H01R 13/658 439/607.28 |
| 2014/0024263 | A1 * | 1/2014 | Dong | H01R 13/516 439/660 |
| 2015/0244111 | A1 * | 8/2015 | Ju | H01R 13/6585 439/607.05 |

* cited by examiner

*Primary Examiner* — Chandrika Prasad
(74) *Attorney, Agent, or Firm* — Chun-Ming Shih; HDLS IPR Services

(57) ABSTRACT

An electrical connector includes an insulation main body and a plurality of conductive terminals. The insulation main body is formed with a tongue. The tongue is formed with a first surface and a second surface opposite to the first surface. Each of the conductive terminals is installed in the tongue. Each of the conductive terminals is formed with a first contact part, a second contact part and a solder part. The first contact part is exposed on the first surface, and the second contact part is exposed on the second surface. The solder part is vertically connected to the first contact part or the second contact part and protruded out of the tongue. Accordingly, the electrical connector complying with the USB Type-C specification, allowing conductive terminals having the same definitions to be integrated and being specially used for power delivery is provided.

10 Claims, 8 Drawing Sheets

ELECTRICAL CONNECTOR HAVING A TERMINAL WITH TWO CONTACT PARTS AND A SOLDER PART

BACKGROUND OF THE INVENTION

1. Field of the Invention

The present invention relates to a USB Type-C electrical connector, especially to an electrical connector complying with the USB Type-C specification and specially used for power delivery.

figures) is normally inserted, the connector is in contact with the upper row (A row); when the corresponding connector (not shown in figures) is reversely inserted, the connector is in contact with the lower row (B row), so the signal of USB Type-C can be electrically conducted whether being normally or reversely inserted. In addition, because the USB Type-C has a function of supporting power delivery (PD), and the output current of 1.5 A and 3 A is also defined, thus the output current is larger than the conventional USB Type A/B. However, the power delivery function requires CC1, CC2 (configuration channel) for detection so as to transmit the signal of USB power delivery protocol.

| A1 | A2 | A3 | A4 | A5 | A6 | A7 | A8 | A9 | A10 | A11 | A12 |
|---|---|---|---|---|---|---|---|---|---|---|---|
| GND | TX1+ | TX1- | Vbus | CC1 | D+ | D- | SBU1 | Vbus | RX2- | RX2+ | GND |
| | | | | | | | | | | | |
| GND | RX2+ | RX2- | Vbus | SBU1 | D- | D+ | CC2 | Vbus | TX1- | TX1+ | GND |
| B12 | B11 | B10 | B9 | B8 | B7 | B6 | B5 | B4 | B3 | B2 | B1 |

2. Description of Related Art

A universal serial bus (hereinafter referred as USB) is a serial port bus standard for connecting a computer system and a peripheral device, in other words it is a technical regulation of an input/output interface which is commonly used in an information communicating product such as a personal computer and a mobile device. With the demand for higher transmission speed and larger storage capacity, the transmission speed of USB has been developed to the USB 3.1 specification (super speed+) from the USB 1.0 specification (12 Mbps at maximum), and a maximum transmission speed up to 10 Gbps can be provided for satisfying the user's expectation of getting a faster transmission speed while a larger file being transmitted so as to effectively shorten the required transmission time.

A USB Type-C is a novel design in accordance with the USB 3.1 specification, the most-noticeable feature in the appearance is the upper row and the lower row are identical, this means that the user has no longer need to tell the positive side and the negative side of the USB (in other words the fool-proof design being removed), and the USB can be inserted in dual directions. The dimension of the USB Type-C interface is 8.3*2.5 mm, which is smaller than the current USB used in a personal computer, and the Type-C is able to be applied in a thinner and smaller device, such as a mobile phone or a tablet computer. The USB Type-C is unable to be directly inserted in a Type-A, Type-B or Micro-B port, but an adapter can be used for allowing the Type-C to be applied in the current devices. In addition, the voltage supplying capacity of USB Type-C is increased to 5V and the current supplying capacity thereof is increased to 900 mA which is larger than the output current of a conventional USB 2.0, thereby being able to satisfy more requirements.

The table provided below shows the pin definitions of the USB Type-C terminals under the regulation of USB 3.1. The new terminal regulation defines the terminals at the upper and the lower rows respectively have 12 pins which are diagonally symmetric. So when a corresponding connector (not shown in In view of what has been mentioned above, the applicant of the present invention has found out that most of the consumers only use the USB for power delivery (charging) and has comprehensive knowledge about the new regulations of USB Type-C terminal definitions; the applicant has devoted himself for researching and developing, thus a novel electrical connector complying with the USB Type-C structure and capable of achieving other effects is provided.

SUMMARY OF THE INVENTION

The present invention is to provide an electrical connector complying with the USB Type-C specification, allowing conductive terminals having the same definitions to be integrated for lowering the cost and the expenditure for researching and developing, and being specially used for power delivery.

Accordingly, the present invention provides an electrical connector, which includes an insulation main body and a plurality of conductive terminals. The insulation main body is formed with a tongue. The tongue is formed with a first surface and a second surface opposite to the first surface. Each of the conductive terminals is installed in the tongue. Each of the conductive terminals is formed with a first contact part, a second contact part and a solder part. The first contact part is exposed on the first surface, and the second contact part is exposed on the second surface. The solder part is vertically connected to the first contact part or the second contact part and protruded out of the tongue.

In comparison with related art, the present invention has advantageous features as follows: the electrical connector provided by the present invention is specially used for charging an electronic device; according to the present invention, only ten diagonally-symmetric conductive terminals (GND, Vbus, CC1/CC2 (configuration channel), Vbus and GND) are installed, other pins are not required according to the USB Type-C specification; the present invention allows the installed conductive terminals arranged at the upper row and the lower row and having the same definitions to be integrated, so only five conductive terminals are required, and each of the conductive terminals is formed with single solder part, thereby lowering the cost and the expenditure for researching and developing; and the present invention further includes an insulation housing which covers a metal enclosure for being used with an electronic device. Accordingly, with the structural design provided by the present invention and the USB power delivery feature, an electrical connector which is economical and specially used for charging is provided.

DETAILED DESCRIPTION OF THE INVENTION

Figure 1:
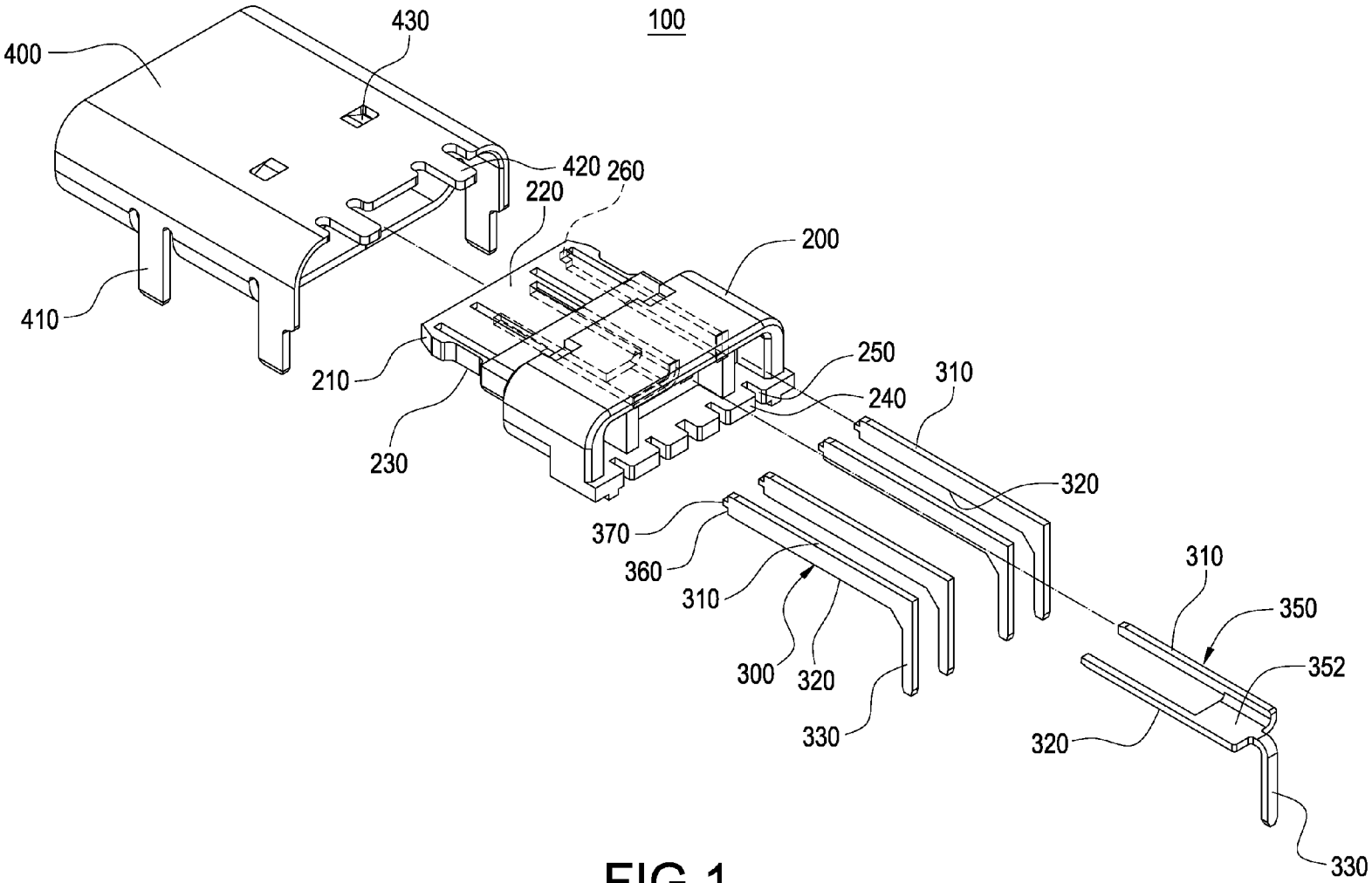
FIG. 1 is an exploded view according to a first embodiment of the present invention.

Preferred embodiments of the present invention will be described with reference to the drawings.

The present invention provides an electrical connector complying with the USB Type-C specification and specially used for electrically charging an electronic device. The above-mentioned electrical connector is preferably to be a connector socket soldered on a circuit board (the board surface). What shall be addressed is that the electrical connector can also be a connector socket soldered on a cable (the cable end) according to actual needs.

Please refer from FIG. 1 to FIG. 5, the electrical connector 100 provided by the present invention includes an insulation main body 200 and a plurality of conductive terminals 300. One end of the insulation main body 200 is protrudingly formed with a tongue 210. The tongue 210 is formed with a first surface 220 and a second surface 230 opposite to the first surface 220. The dimension of the insulation main body 200 is preferably to be 8.34*2.56 mm so as to comply with the USB Type-C specification. Each of the conductive terminals 300 is installed in the tongue 210 of the insulation main body 200 with an assembling or an insert molding means. Each of the conductive terminals 300 is formed with a first contact part 310, a second contact part 320 and single solder part 330. As shown from FIG. 2 to FIG. 5, the first contact part 310 is exposed on the first surface 220, and the second contact part 320 is exposed on the second surface 230, thereby being able to be electrically conducted with a corresponding electrical connector (not shown in figures).

Figure 4:
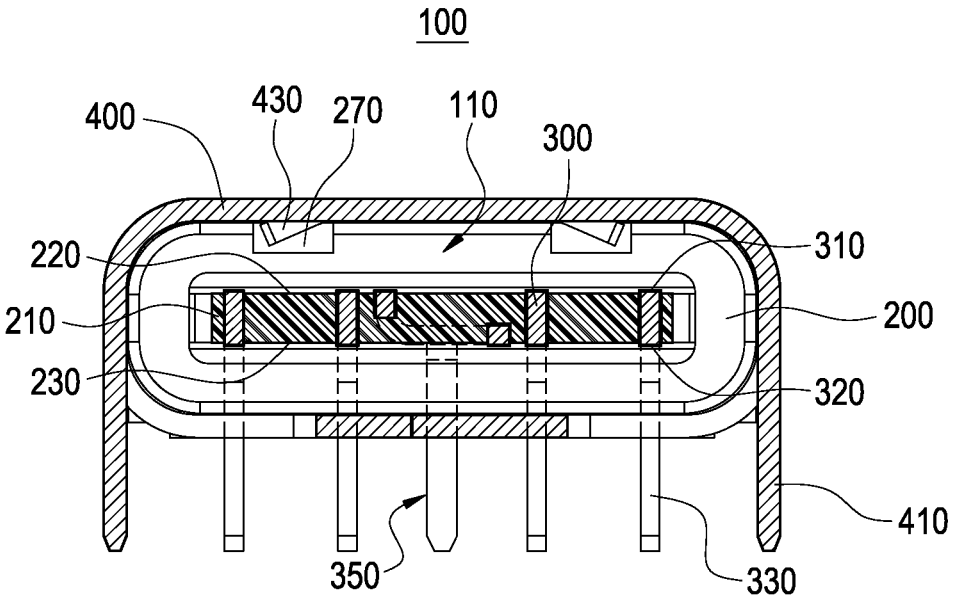
FIG. 4 is a cross sectional view according to the first embodiment of the present invention.

According to the embodiment disclosed in FIG. 4, the first contact part 310 is preferably to be slightly higher than the horizontal level of the first surface 220, and the second contact part 320 is preferably to be slightly higher than the horizontal level of the second surface 230, thereby being able to be easily and electrically conducted with the corresponding electrical connector (not shown in figures). What shall be addressed is that the first contact part 310 or the second contact part 320 can also be equal to or slightly lower than the horizontal level of the first surface 220 or the second surface 230 according to actual needs.

Figure 2:
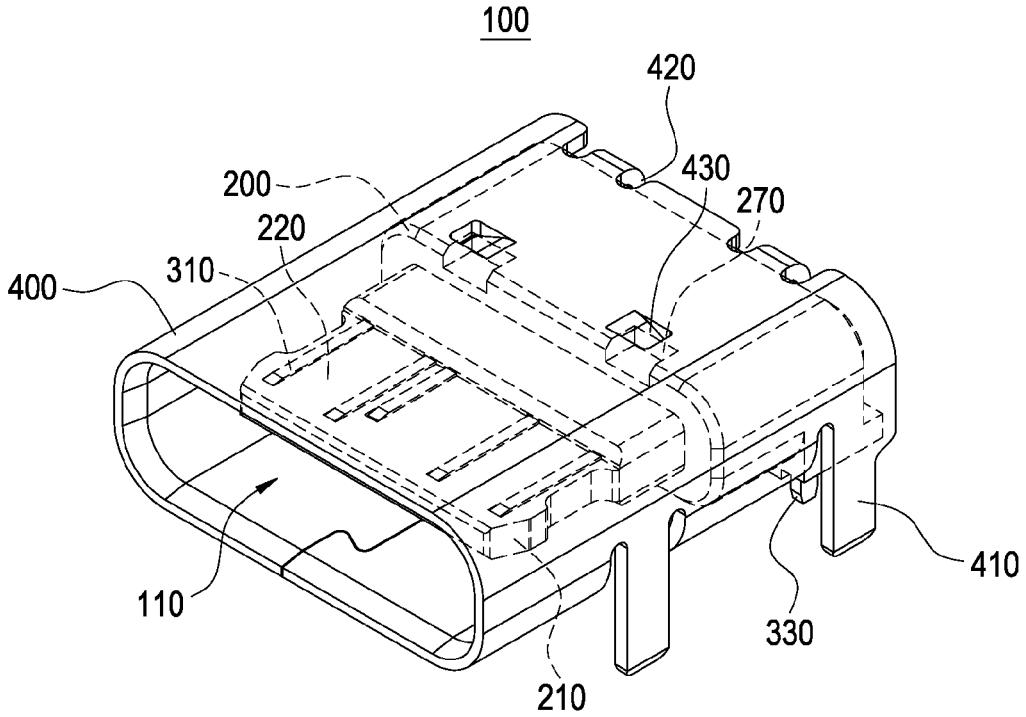
FIG. 2 is a perspective view according to the first embodiment of the present invention.
Figure 3:
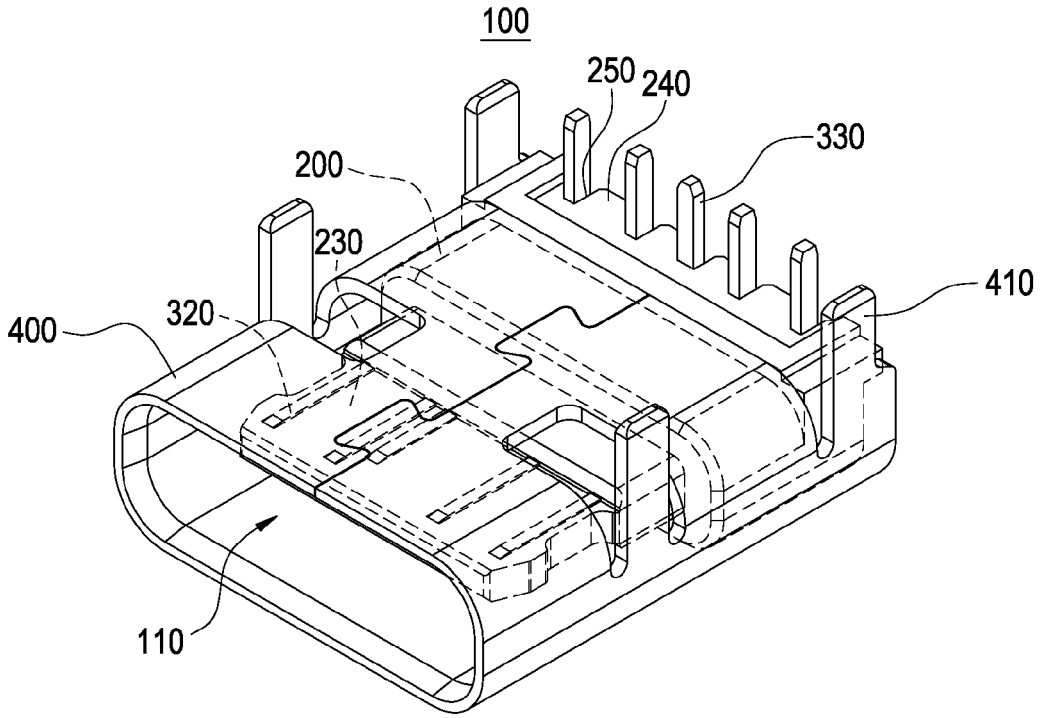
FIG. 3 is another perspective view according to the first embodiment of the present invention.
Figure 5:
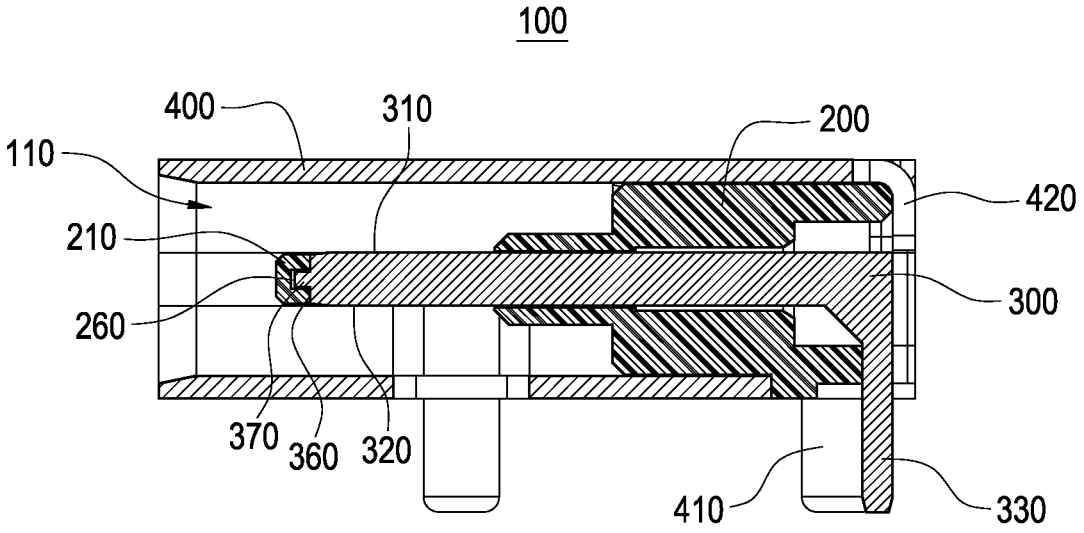
FIG. 5 is another cross sectional view according to the first embodiment of the present invention.
Figure 6:
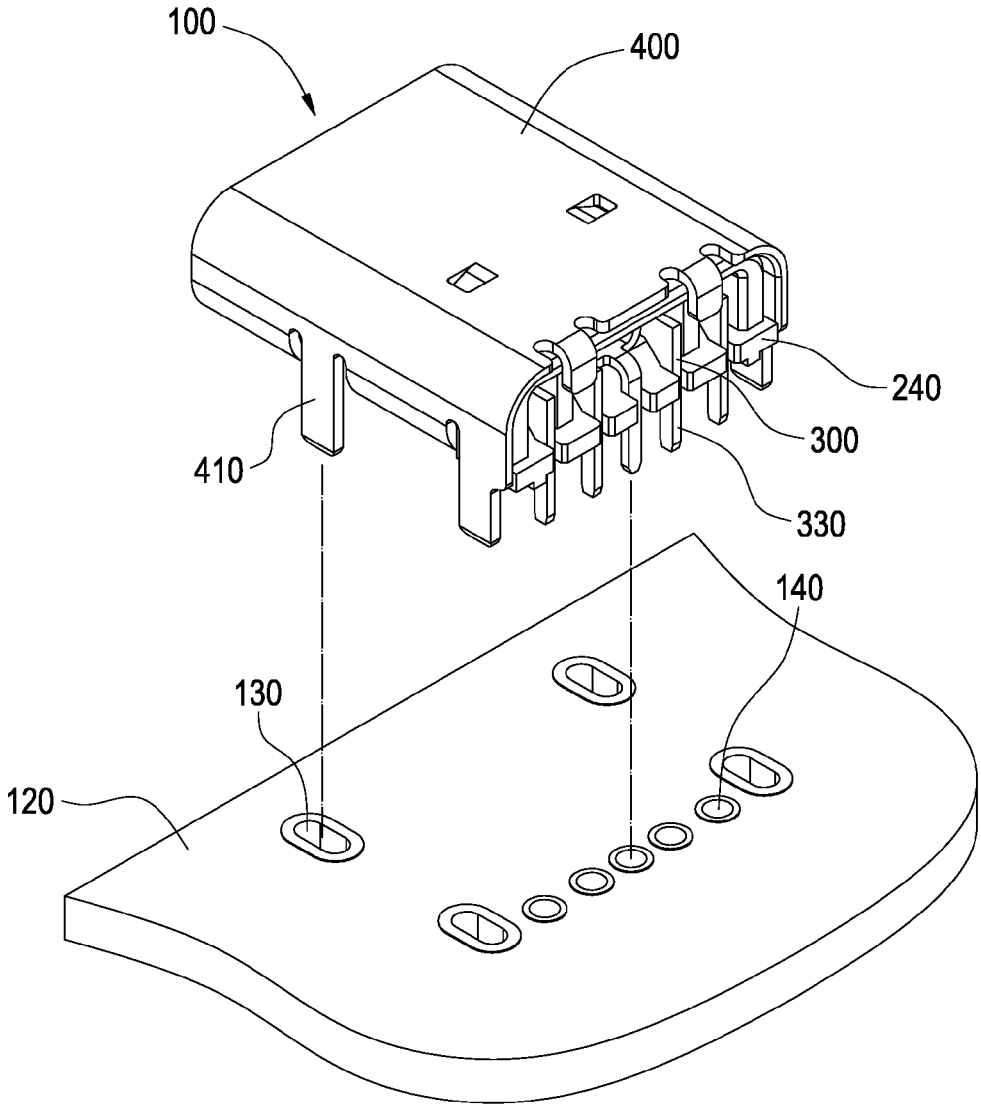
FIG. 6 is an exploded view showing the electrical connector being installed on a circuit board according to the first embodiment of the present invention.

The present invention further includes a metal enclosure 400, so an effect of electromagnetic interference (EMI) prevention can be provided. As shown from FIG. 2 to FIG. 5, the metal enclosure 400 is served to enclose the insulation main body 200, so an insertion space 110 is formed between the metal enclosure 400 and the tongue 210, thereby allowing the corresponding electrical connector (not shown in figures) to be inserted. The metal enclosure 400 is formed with a plurality of positioning sheets 410, at least one positioning part 420 and at least one buckle part 430. The extending direction of each of the positioning sheets 410 is parallel to the extending direction of each of the solder parts 330 thereby enabling positioning holes 130 of a circuit board 120 to be positioned as shown in FIG. 6. According to the embodiment disclosed in FIG. 6, each of the solder parts 330 is preferably to be soldered with each corresponding electrical contact 140 of the circuit board 120 with a dual in-line package (DIP) means. However according to another embodiment, each of the solder parts 330 can also be soldered with each of the corresponding electrical contacts 140 of the circuit board 120 with a surface mount technology (SMT) means. As shown in FIG. 5, the at least one positioning part 420 is formed through being bent at one side of the metal enclosure 400 with a secondary processing means thereby preventing the insulation main body 200 from being displaced towards the tongue 210. The at least one buckle part 430 is formed at one side of the metal enclosure 400 for allowing a buckle slot 270 of the insulation main body 200 to be positioned so as to further limit the insulation main body 200 as shown in FIG. 2 and FIG. 4. What shall be addressed is that the quantity of the positioning sheet 410, the quantity of the positioning part 420 and the quantity of the buckle part 430 are not limited to a certain amount, the actual amount can be determined according to actual needs.

As shown in FIG. 1, FIG. 4 and FIG. 5, the first contact part 310 and the second contact part 320 are preferably to be arranged in parallel and corresponding to each other, and the first contact part 310 and the second contact part 320 are preferably to be integrally formed with the solder part 330. In other words, the contact portion (not specified in figures) of each of the conductive terminals 300 is preferably to be formed in a plate-like status, so the first contact part 310 and the second contact part 320 are able to be connected together for forming a stronger structure. The solder part 330 is vertically connected to the first contact part 310 and/or the second contact part 320 and protruded out of the tongue 210. As shown in FIG. 1, the insulation main body 200 further includes a plurality of partition pieces 240 and a plurality of recesses 250. Each of the partition pieces 240 and each of the recesses 250 are adjacently arranged, each of the solder parts 330 is positioned in each of the recesses 250, and each of the partition pieces 240 is served to separate each of the solder parts 330.

According to the present invention, only diagonally symmetric pins such as GND, Vbus, CC1/CC2 (configuration channel), Vbus and GND are installed, and other pins are not required according to the USB Type-C specification. The present invention allows the conductive terminals arranged at the upper row and the lower row and having the same definitions to be integrated, so only five conductive terminals 300 are required according this embodiment, thereby lowering the cost and the expenditure for researching and developing. Especially as shown in FIG. 1 and FIG. 4, because the pin distance defined between the first contact part 310 and the second contact part 320 of a configuration channel terminal 350 is relatively greater, the first contact part 310 and the second contact part 320 are designed to be staggeringly arranged, and a fasten part 352 is served to connect the two contact parts 310, 320. The contact portion of the configuration channel terminal 350 is different from the contact portions of other conductive terminals 300, but the configuration channel terminal 350 is also formed with single solder part 330, thereby allowing each of the solder parts 330 to be linearly arranged so as to be respectively soldered on each of the electrical contacts 140 of the circuit board 120, as shown in FIG. 6.

According to the first embodiment disclosed in FIG. 1, each of the conductive terminals 300 further includes a connection part 360 and a convex part 370. The convex part 370 is formed at the front edge of the connection part 360, and the connection part 360 is respectively connected to first contact part 310 and the second contact part 320. When each of the conductive terminals 300 is formed on the tongue 210 of the insulation main body 200 with a mounting means, the tongue 210 is further formed with a positioning slot 260 allowing the convex part 370 to be positioned. In other words, with the installation of the convex part 370 and the positioning slot 260, the precise location of each of the conductive terminals 300 can be ensured during the mounting process, as shown in FIG. 5.

Figure 7:
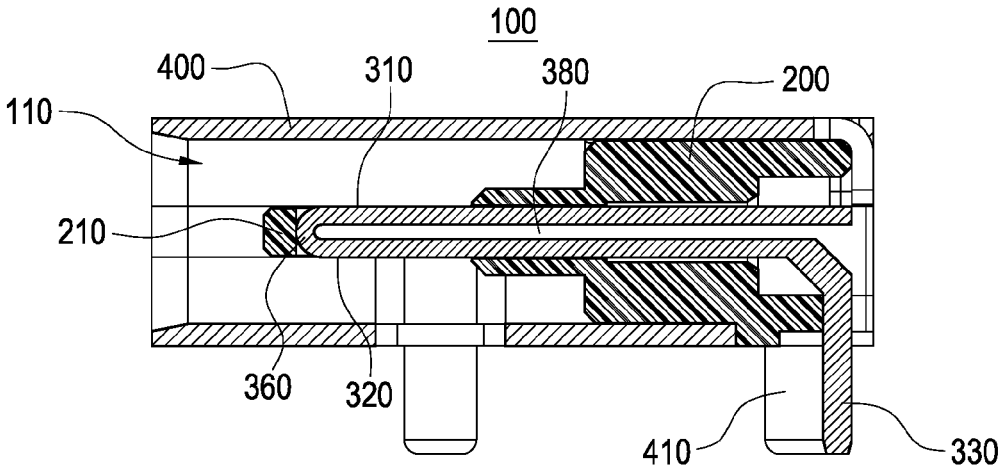
FIG. 7 is a cross sectional view according to a second embodiment of the present invention.
Figure 8:
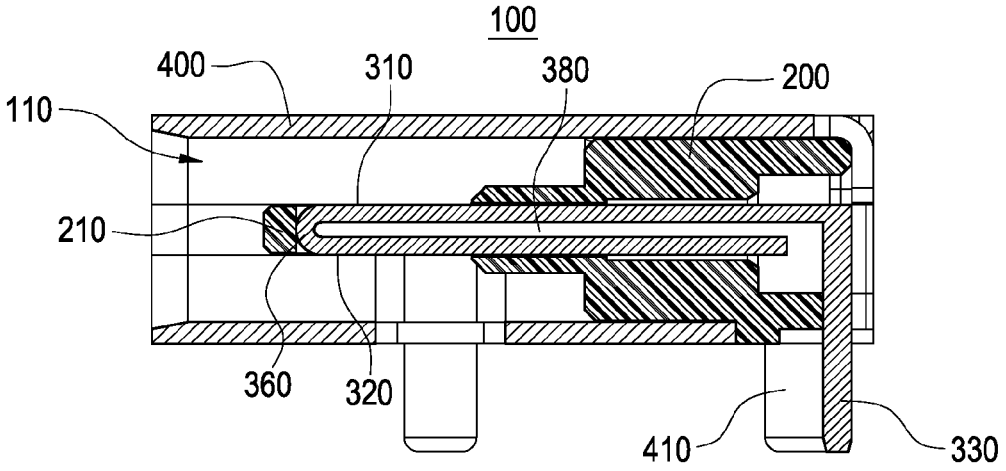
FIG. 8 is a cross sectional view according to a third embodiment of the present invention.
Figure 9:
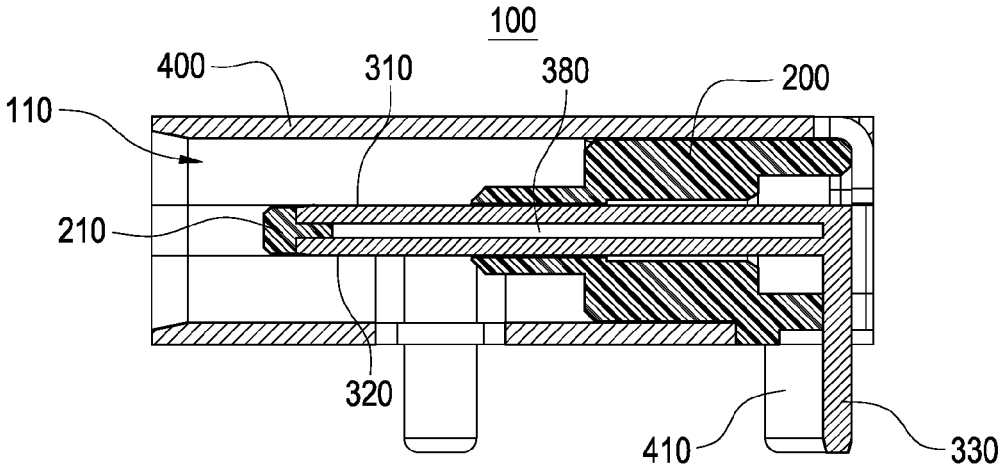
FIG. 9 is a cross sectional view according to a fourth embodiment of the present invention.

In addition, according to the first embodiment, the solder part 330 is preferably to be vertically connected to both of the first contact part 310 and the second contact part 32. However, according to the second embodiment disclosed in FIG. 7, the solder part 330 is only vertically connected to the second contact part 320, the first contact part 310 is not in contact with the solder part 330, so a gap 380 is formed between the first contact part 310 and the second contact part 320, thereby achieving a cost saving and other effects. According to the third embodiment disclosed in FIG. 8, the solder part 330 is only vertically connected to the first contact part 310, the second contact part 320 is not in contact with the solder part 330, so a gap 380 is formed between the first contact part 310 and the second contact part 320, thereby achieving a cost saving and other effects. According to the embodiments disclosed in FIG. 1, FIG. 7 and FIG. 8, the first contact part 310 and the second contact part 320 are able to be integrally formed through being connected by the connection part 360. According to the fourth embodiment disclosed in FIG. 9, the first contact part 310 and the second contact part 320 are not formed with the connection part 360, and the solder part 330 is served to connect the two contact parts 310, 320 so as to be integrally formed. As such, the objective of specially used for power delivery can be achieved regardless to the structural status of the conductive terminal 300.

Figure 10:
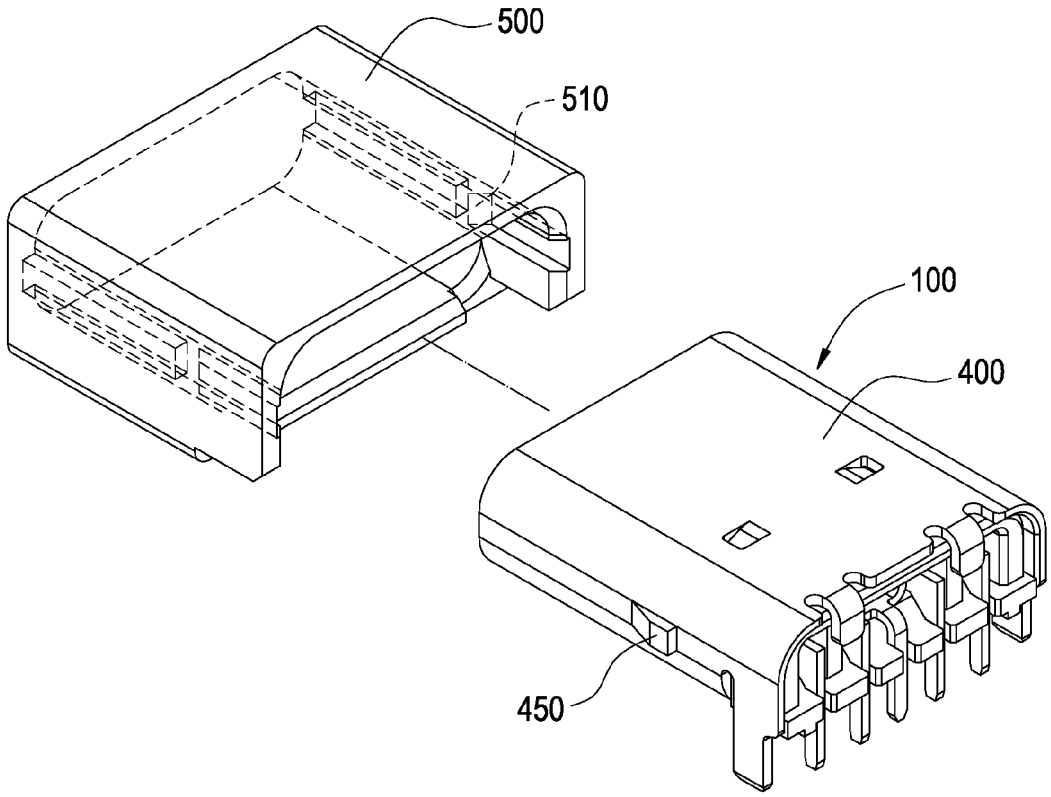
FIG. 10 is an exploded view showing the electrical connector being installed with an insulation housing according to the present invention.
Figure 11:
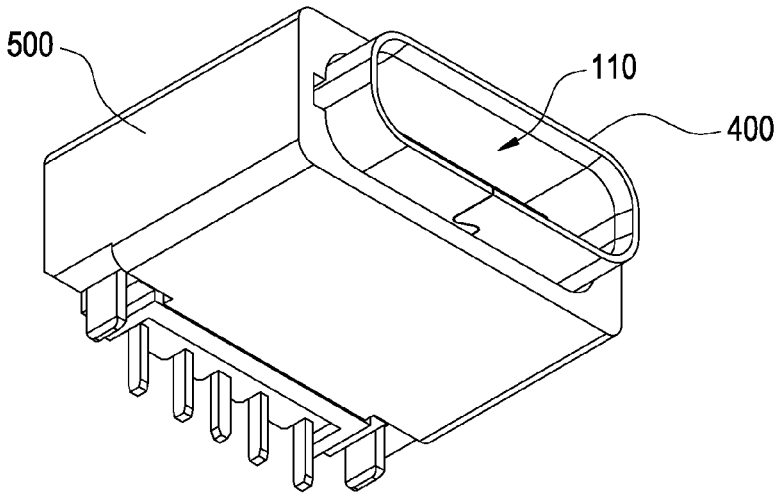
FIG. 11 is a perspective view of FIG. 10.
Figure 12:
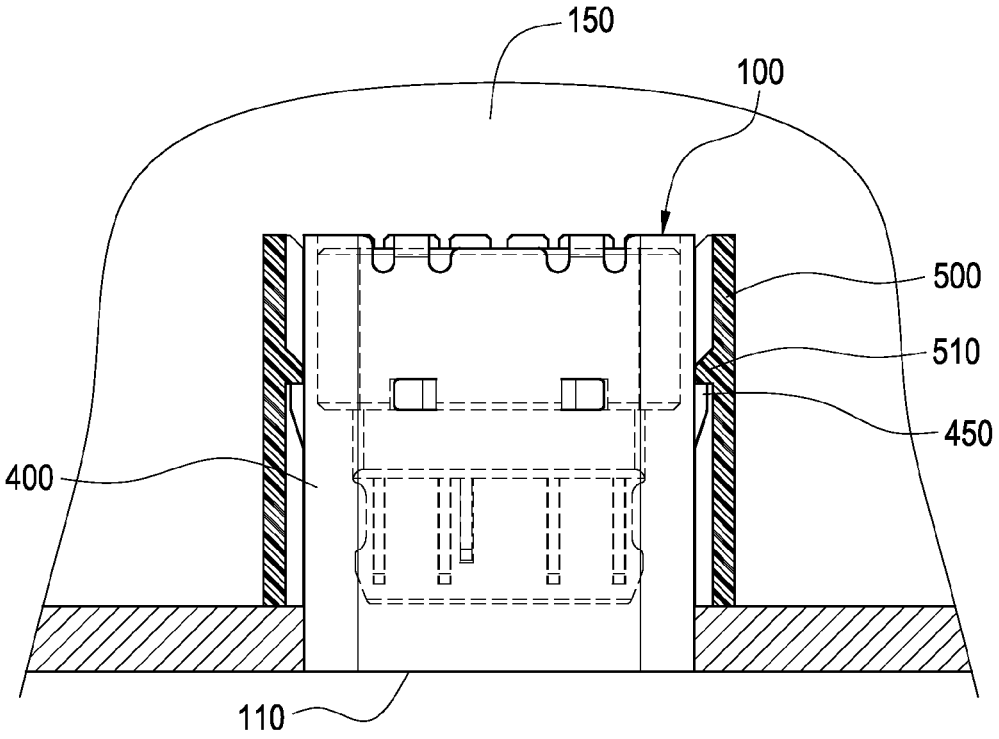
FIG. 12 is a cross sectional view showing the electrical connector being assembled in an electronic device according to the present invention.

Please refer to FIG. 10 to FIG. 12, the present invention further includes an insulation housing 500 which covers the metal enclosure 400 for being used with an electronic device 150. As shown in FIG. 10 and FIG. 11, two sides of the metal enclosure 400 are respectively formed with a buckle part 450 for respectively allowing buckle slots 510 formed at inner walls of the insulation housing 500 to be positioned so as to limit the relative displacement of the electrical connector 100. As shown in FIG. 12, which is a cross sectional view showing the electrical connector being assembled in an electronic device according to the present invention. According to this embodiment, the electronic device 150 can be a mobile phone, a tablet computer or other suitable electronic devices. With the installation of the insulation housing 500, the electrical connector 100 of the present invention is able to be fastened on a housing of the electronic device 150, wherein an inserting port of the insertion space 110 is oriented towards the exterior of the housing of the electronic device 150, thereby allowing an inserted plug (not shown in figures) to be used for charging. As such, with the structural design provided by the present invention and the USB power delivery feature, the electrical connector 100 is able to be specially used for charging the electronic device 150.

Figure 13:
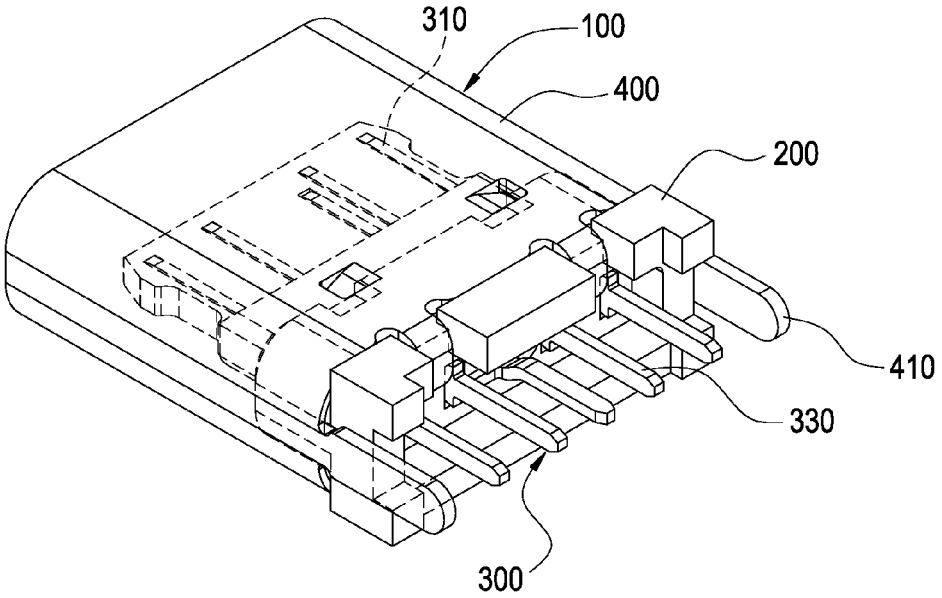
FIG. 13 is a schematic view showing the electrical connector according to another embodiment of the present invention.
Figure 14:
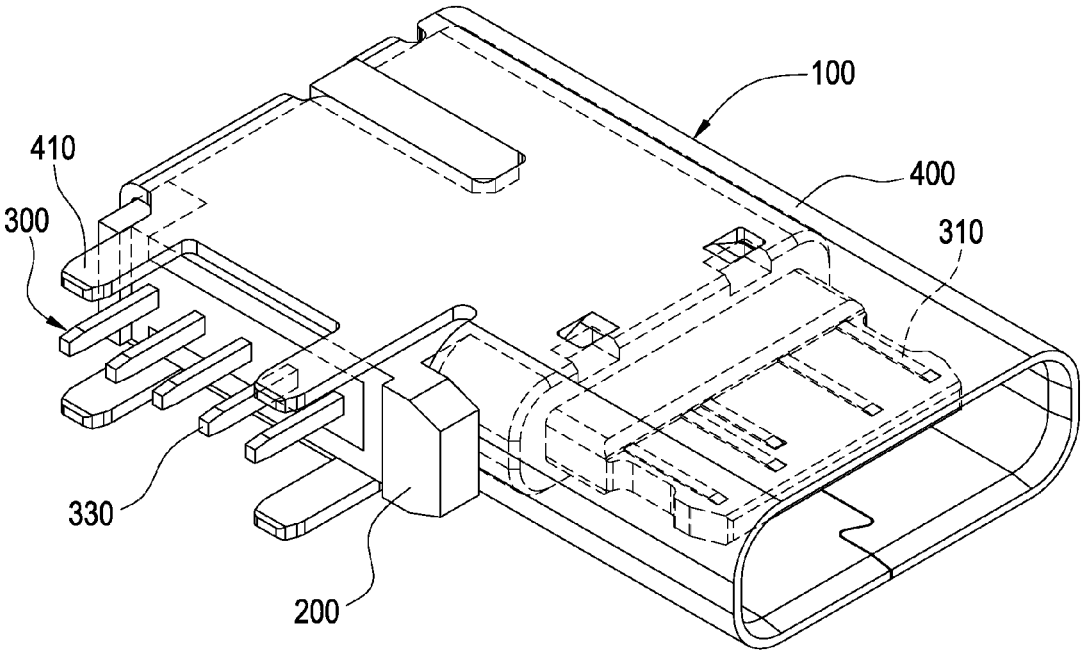
FIG. 14 is a schematic view showing the electrical connector according to one another embodiment of the present invention.

Please refer to FIG. 13 and FIG. 14, which are schematic perspective views according to two embodiments of the present invention. The difference between the embodiments disclosed in FIG. 13 and FIG. 14 and the previous embodiments is the assembly means of the circuit board (not shown in figures). Furthermore, as shown in FIG. 13, the solder part 330 of the conductive terminal 300 is preferably to be in parallel with the contact parts 310, 320 and protruded out of the insulation main body 200. Each of the positioning sheets 410 of the metal enclosure 400 is parallel to the solder part 330 and protruded out of the insulation main body 200 for being matched with assembling direction of the circuit board (not shown in figures). As shown in FIG. 14, the solder part 300 is protruded from one side of the metal enclosure 400, in other words the solder part 330 is vertically connected to the contact parts 310, 320 and protruded out of the insulation main body 200. Each of the positioning sheets 410 of the metal enclosure 400 is parallel to the solder part 330 and protruded out of the insulation main body 200 for being matched with assembling direction of the circuit board (not shown in figures). Other structural configuration of the electrical connector 100 is shown in FIG. 13 and FIG. 14, therefore no further illustration is provided.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An electrical connector, including:

an insulation main body, formed with a tongue, wherein the tongue is formed with a first surface and a second surface opposite to the first surface; and a plurality of conductive terminals, installed in the tongue, wherein each of the conductive terminals is formed with a first contact part, a second contact part and a solder part, the first contact part is exposed on the first surface, the second contact part is exposed on the second surface, and the solder part is vertically connected to the first contact part or the second contact part and protruded out of the tongue.

2. The electrical connector according to claim 1, further including a metal enclosure served to enclose the insulation main body, so an insertion space is formed between the metal enclosure and the tongue; the metal enclosure is formed with a plurality of positioning sheets, and an extending direction of each of the positioning sheets is parallel to an extending direction of each of the solder parts.

3. The electrical connector according to claim 2, further including an insulation housing covering the metal enclosure.

4. The electrical connector according to claim 1, wherein the quantity of the conductive terminals is five, and the telecommunication definition of each of the conductive terminals is respectively defined as GRD (ground), Vbus (voltage bus), CC1/CC2 (configuration channel), Vbus and GND.

5. The electrical connector according to claim 4, wherein the configuration channel terminal further includes a fasten part, the fasten part is respectively connected to the first contact part and the second contact part, and the first contact part and the second contact part are staggeringly arranged.

6. The electrical connector according to claim 1, wherein the insulation main body further includes a plurality of partition pieces and a plurality of recesses, each of the partition pieces and each of the recesses are adjacently arranged, each of the solder parts is positioned in each of the recesses, and each of the partition pieces is served to separate each of the solder parts.

7. The electrical connector according to claim 1, wherein the first contact part and the second contact part are arranged in parallel and corresponding to each other, and the first contact part and the second contact part are integrally formed with the solder part.

8. The electrical connector according to claim 7, wherein each of the conductive terminals further includes a connection part and a convex part, the convex part is formed at the front edge of the connection part, the connection part is respectively connected to the first contact part and the second contact part, and the solder part is connected to the first contact part or the second contact part.

9. The electrical connector according to claim 7, wherein the solder part is further connected to the first contact part and the second contact part.

10. The electrical connector according to claim 8, wherein the interior of the tongue of the insulation main body is further formed with a positioning slot allowing the convex part to be positioned.

* * * * *